US005195912A

United States Patent [19]

Lintott

[11] Patent Number: 5,195,912

[45] Date of Patent: Mar. 23, 1993

[54] ELECTRICAL CONNECTORS

[75] Inventor: Edward R. Lintott, London, England

[73] Assignee: Lucas Industries, England, United Kingdom

[21] Appl. No.: 826,978

[22] Filed: Jan. 28, 1992

[30] Foreign Application Priority Data

Feb. 5, 1991 [GB] United Kingdom ..... 9102465

[51] Int. Cl.[5] ..... H01R 21/00

[52] U.S. Cl. ..... 439/685; 439/777; 439/596

[58] Field of Search ..... 439/130, 623, 660, 685, 439/596, 777, 801, 883

[56] References Cited

U.S. PATENT DOCUMENTS

| | | | |
|---|---|---|---|
| 1,378,952 | 5/1921 | Hawthorne | 439/801 X |
| 4,013,334 | 3/1977 | Behnke | 439/130 |
| 4,017,141 | 4/1977 | Bury et al. | 439/596 |
| 4,865,553 | 9/1989 | Tanigawa et al. . | |

FOREIGN PATENT DOCUMENTS

| | | | |
|---|---|---|---|
| 086790 | 2/1966 | France | 439/685 |
| 0096028 | 5/1960 | Netherlands | 439/777 |
| 861198 | 2/1961 | United Kingdom . | |

*Primary Examiner*—Larry I. Schwartz
*Assistant Examiner*—Khiem Nguyen

[57] ABSTRACT

An electrical connector for forming an electrical connection to a pair of electrical terminals comprises first and second electrical connection members each having an eyelet formed with an arcuate, terminal-receiving slot. The connection members are held in fixed relative positions by either mounting them on, or moulding them into, an electrically insulating disc, or by clamping them by means of a clamping bar. In the connected condition of the connector the arcuate, terminal-receiving slots formed in the eyelets span at least opposite quadrants of a circle passing through the electrical terminals.

10 Claims, 2 Drawing Sheets

ELECTRICAL CONNECTORS

BACKGROUND OF THE INVENTION

This invention relates to electrical connectors.

It is often necessary to form an electrical connection to the electrical terminals of an electrical component which is a screw fit in a receiving socket. In such circumstances, the electrical terminals could assume any final angular orientation, and so it has been customary to use connection wires that are longer than necessary for some angular orientations of the terminals.

This problem has arisen, for example, when forming wired connections to the terminal posts of an electromagnetic actuator for a unit injector pump of an engine. The actuator is located inside the rocker casing of the engine and it is desirable to keep all wired connections as short as possible - excessively long wires tend to vibrate and are subject to wear, and they could snag or catch on moving components inside the rocker casing.

It is an object of the invention to provide an electrical connector that substantially alleviates the aforementioned problem.

BRIEF SUMMARY OF THE INVENTION

According to one aspect of the invention there is provided an electrical connector for forming electrical connections to at least two electrical terminals, the electrical connector comprising at least two electrical connection members each having a respective terminal-receiving slot and forming, in use, an electrical connection between a said terminal received in the slot and an electrical conductor attached to that electrical connection member, the electrical connection members being so configured as to be capable of providing sites of attachment for the electrical conductors at locations that are independent of the angular orientation of the electrical terminals received in the terminal-receiving slots.

According to a further aspect of the invention there is provided an electrical connector for forming an electrical connection to a pair of electrical terminals, the electrical connector comprising first and second electrical connection members each having a respective terminal-receiving slot and forming, in use, an electrical connection between a said terminal received in the slot and an electrical conductor attached to that electrical connection member, and wherein the terminal-receiving slots span at least opposite quadrants of a circle passing through the two electrical terminals received in the terminal-receiving slots.

In a preferred embodiment of the invention the terminal-receiving slots are arcuate in shape.

The electrical connector may include means for holding the electrical connection members in fixed relative positions, and, to that end, the electrical connection members may be mounted on, formed on or moulded in an electrically insulating support member.

Alternatively the electrical connection members may be held in fixed relative positions by clamping means.

The electrical connection members may have tangs and the clamping means may be of two-part construction and may be a snap fit around the tangs or around the electrical conductors attached to the tangs.

The invention also provides an electrical connection member for an electrical connector according to said further aspect of the invention, comprising an eyelet having a terminal-receiving slot subtending an angle of at least 90°.

BRIEF DESCRIPTION OF THE DRAWINGS

Electrical connectors according to the invention will now be described, by way of example, with reference to the accompanying drawings in which.

DESCRIPTION OF PREFERRED EMBODIMENTS

Figure 1A:
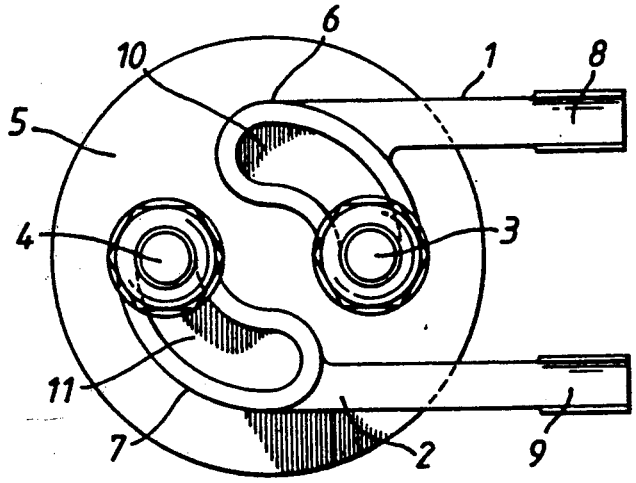
FIGS. 1*a* and 1*b* show respectively plan and side elevation views of an electrical connector in accordance with the invention.
Figure 1B:
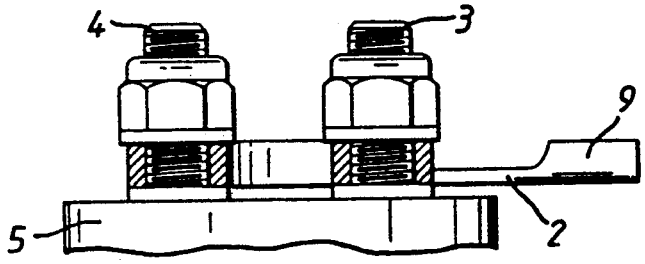

Referring now to FIG. 1*a*, the electrical connector comprises a first connection member 1 and a second connection member 2, and each is connected to a respective terminal post 3,4 of an electromagnetic actuator 5, for a unit injector pump, for example. The connection members are fixed in place on the terminal posts by nuts or screws.

Each connection member 1,2 has a slotted eyelet 6,7 and a tang 8,9 to which a wire can be attached, by either crimping the sides of the tang around the wire or by forming a soldered connection. The eyelet and the tang are of one piece construction and may be manufactured by stamping from sheet metal, such as brass.

Each eyelet has an arcuate, terminal-receiving slot 10,11 which subtends an angle slightly greater than 90°. In the connected condition, the slots 10,11 span opposite quadrants of a circle passing through the two terminals.

Figure 2A:
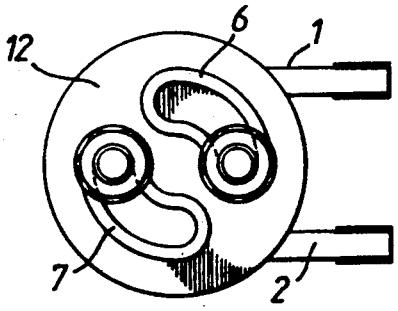
FIGS. 2*a* and 2*b* show respectively plan and side elevation views of another electrical connector in accordance with the invention having the electrical connection members held in fixed relative positions by an electrically insulating support.
Figure 2B:
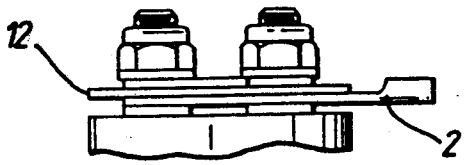

As shown in FIGS. 2*a* and 2*b*, the first and second connection members 1,2 may be held in fixed relative positions by mounting them on, or alternatively moulding them into, an electrically insulating disc 12. Alternatively, the connection members could be formed by electro-deposition onto the insulating disc. With this arrangement, the electrical connector can always be connected to the terminal posts in accordance with a required wiring configuration regardless of the angular orientation of the terminal posts, thereby obviating the need to provide wires of excessive length for attachment to the tangs 8,9.

If, at an initial attempt, the terminal posts cannot be located in the terminal-receiving slots 10,11, the connector can simply be inverted, displacing the slots to the opposite quadrants and allowing the terminal posts to be received in the slots. However, the configuration of the tangs is such that the locations at which wires may be attached remain unchanged, even when the connector is inverted, and so the wires can be kept as short as possible.

Figure 3A:
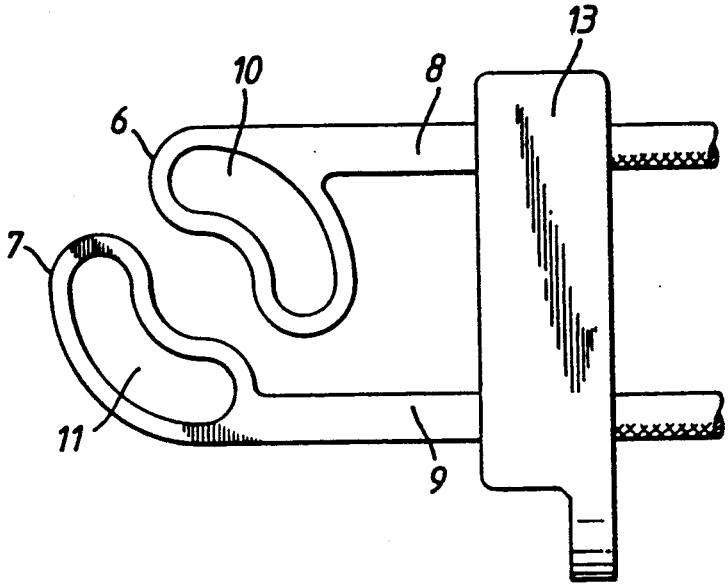
FIG. 3*a* shows a plan view of the electrical connection members held in fixed relative positions by a clamping bar.
Figure 3B:
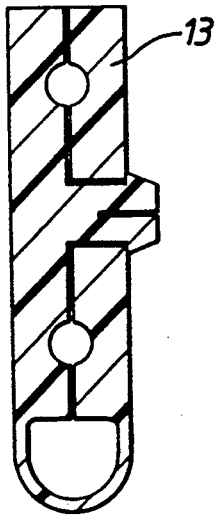
FIG. 3*b* shows a cross-sectional view through the clamping bar.

Instead of using an electrically insulating disc 12, the two electrical connection members could be held in fixed relative positions by means of a clamping bar 13, as shown in FIG. 3*a*. As shown in FIG. 3*b*, the bar may be of two part construction, and may be made from a plastics material, for example. The clamping bar shown in FIGS. 3*a* and 3*b* is a snap fit around the tangs, or alternatively around the wires attached to the tangs.

A slide cover (not shown in the drawings) can be fitted to slide over the insulating disc 12 or clamping bar 13 to provide protection to the connection which has been formed.

I claim:

1. An electrical connector for forming electrical connections to at least two electrical terminals, the electrical connector comprising at least two electrical connection members each having a respective terminal-receiving slot and forming, in use, an electrical connection between a said terminal received in the slot and an electrical conductor attached to that electrical connection member, the electrical connection members being so configured as to be capable of providing sites of attachment for the electrical conductors at locations that are independent of the angular orientation of the electrical terminals received in the terminal-receiving slots.

2. An electrical connector for forming an electrical connection to a pair of electrical terminals, the electrical connector comprising first and second electrical connection members each having a respective terminal-receiving slot and forming, in use, an electrical connection between a said terminal received in the slot and an electrical conductor attached to that electrical connection member, wherein the terminal-receiving slots span at least opposite quadrants of a circle passing through the two electrical terminals received in the terminal-receiving slots, and the electrical connection members are configured to provide sites of attachment for the electrical conductors at locations that are independent of the angular orientation of the electrical terminals.

3. An electrical connector as claimed in claim 2, wherein the terminal-receiving slots are arcuate.

4. An electrical connector as claimed in claim 2, including means for holding the electrical connection members in fixed relative positions.

5. An electrical connector as claimed in claim 4, wherein the electrical connection members are mounted on an electrically insulating support member.

6. An electrical connector as claimed in claim 4, wherein the means for holding the electrical connection members comprises clamping means.

7. An electrical connector as claimed in claim 6, wherein the electrical connection members have tangs.

8. An electrical connector as claimed in claim 4, wherein the electrical connection members are formed on an electrically insulating support member.

9. An electrical connector as claimed in claim 4, wherein the electrical connection members are moulded in an electrically insulating support member.

10. An electrical connector for forming an electrical connection to a pair of electrical terminals, the electrical connector comprising first and second electrical connection members each having a respective terminal-receiving slot and forming, in use, an electrical connection between a said terminal received in the slot and an electrical conductor attached to that electrical connection member, the terminal-receiving slots spanning at least opposite quadrants of a circle passing through the two electrical terminals received in the terminal-receiving slots, and clamping means for holding the electrical connection members in fixed relative positions, wherein the electrical connection members have tangs and the clamping means is of two-part construction and is a snap fit around said tangs or around electrical conductors attached to the tangs.

* * * * *

UNITED STATES PATENT AND TRADEMARK OFFICE

CERTIFICATE OF CORRECTION

PATENT NO. : 5,195,912

DATED : March 23, 1993

INVENTOR(S) : Edward R. Lintott

It is certified that error appears in the above-indentified patent and that said Letters Patent is hereby corrected as shown below:

On the Title Page, under the Heading [73] Assignee: change "Lucas Industries, England, United Kingdom" to -- Lucas Industries public limited company, England, United Kingdom --

Signed and Sealed this

Twenty-ninth Day of March, 1994

*Attest:*

Bruce Lehman

BRUCE LEHMAN

*Attesting Officer*

*Commissioner of Patents and Trademarks*